US007339475B2

(12) United States Patent
Concari et al.

(10) Patent No.: US 7,339,475 B2
(45) Date of Patent: Mar. 4, 2008

(54) PORTABLE ALARM SYSTEM

(75) Inventors: Gabriel E. Concari, Eldersburg, MD (US); James B. Watson, Fallston, MD (US); Kelton W. Lovell, Baltimore, MD (US)

(73) Assignee: Black & Decker Inc., Newark, DE (US)

( * ) Notice: Subject to any disclaimer, the term of this patent is extended or adjusted under 35 U.S.C. 154(b) by 24 days.

(21) Appl. No.: 10/985,407

(22) Filed: Nov. 10, 2004

(65) Prior Publication Data

US 2006/0097869 A1 May 11, 2006

(51) Int. Cl.
*G08B 13/14* (2006.01)

(52) U.S. Cl. ..... 340/571; 340/541; 340/331; 340/539.11

(58) Field of Classification Search ..... 340/541, 340/331, 571, 539.11
See application file for complete search history.

(56) References Cited

U.S. PATENT DOCUMENTS

| | | | | | |
|---|---|---|---|---|---|
| 4,170,334 | A * | 10/1979 | Villanueva | 248/553 |
| 4,728,936 | A * | 3/1988 | Guscott et al. | 340/525 |
| 5,117,223 | A * | 5/1992 | Tanner | 340/693.5 |
| 5,341,123 | A * | 8/1994 | Schuman et al. | 340/546 |
| 5,489,890 | A * | 2/1996 | Moser | 340/546 |
| 5,574,429 | A * | 11/1996 | Streeter | 340/571 |
| 5,587,700 | A * | 12/1996 | Williams | 340/541 |
| 5,777,551 | A | 7/1998 | Hess | |
| 5,986,548 | A * | 11/1999 | McGregor | 340/539.26 |
| 6,046,674 | A * | 4/2000 | Irwin et al. | 340/539.28 |
| 6,049,273 | A | 4/2000 | Hess | |
| 6,122,830 | A * | 9/2000 | Jarzombek | 30/276 |
| 6,183,417 | B1 * | 2/2001 | Geheb et al. | 600/301 |
| 6,210,329 | B1 * | 4/2001 | Christmas et al. | 600/437 |
| 6,297,745 | B1 | 10/2001 | Meier | |
| 6,433,683 | B1 * | 8/2002 | Robinson | 340/540 |
| 6,441,731 | B1 * | 8/2002 | Hess | 340/539.26 |
| 6,946,959 | B2 * | 9/2005 | Wang | 340/539.22 |
| 6,999,562 | B2 * | 2/2006 | Winick | 379/42 |

FOREIGN PATENT DOCUMENTS

| | | |
|---|---|---|
| DE | 296 22 840 | 7/1997 |
| EP | 1 037 184 | 9/2000 |
| EP | 1 093 099 | 4/2001 |
| EP | 1 387 332 | 2/2004 |

* cited by examiner

*Primary Examiner*—Jeffery Hofsass
*Assistant Examiner*—Edny Labbees
(74) *Attorney, Agent, or Firm*—Harness, Dickey & Pierce, P.L.C.

(57) ABSTRACT

A monitoring system includes a portable alarm having a base unit with an electronic package. At least one sensor is associated with the electronics to transmit signals to the electronics in the event of a breach. The electronic package in turn signals a central monitoring station, as well as transmits a signal to an audible or visual alarm coupled with the base unit. Also, the base unit includes a device to selectively program the electronics to enable the user to utilize particular programs. A bracket, which retains and secures the base unit, may be secured to a surface to enable desirable positioning of the base unit within a structure.

13 Claims, 4 Drawing Sheets

PORTABLE ALARM SYSTEM

FIELD OF THE INVENTION

The present invention relates to alarm systems and, more specifically, to portable alarms which are readily movable from building to building.

In today's society it is desirable to protect personal effects in one's dwelling or building. In doing so, it is desirable to have an alarm system which is monitored by a central monitoring station. Ordinarily, central monitored alarm systems are secured permanently in the walls of the dwelling. For those persons who temporarily use a structure or building, it is cost prohibitive to invest in an alarm system which, upon leaving the building, would be left behind. Thus, it is desirable to have a portable alarm system.

Portable alarm systems exist which include various types of features. Ordinarily, the portable alarm includes a wireless sensor which communicate with the alarm system within the dwelling. The system is portable from dwelling to dwelling as a user moves from place to place. Thus, the user has the convenience of an alarm system and can move the alarm system with him as he moves from place to place. Thus, it is justifiable for temporary building users to purchase portable alarm systems.

SUMMARY OF THE INVENTION

The present invention provides the art with a portable alarm system which enables selective programming of the alarm system. The invention provides wireless sensors which monitor an area and communicate with an alarm base. The present invention enables multiple sensors to communicate with a single base unit. The present invention enables multiple sensors to be positioned in multiple buildings and/or in ambient areas to monitor the area and communicating with a base unit. The present invention enables the base unit to be locked and mounted on a wall or the like. The base unit may include visual as well as audible alarms. Also, the base unit may include sensors to monitor an area.

In accordance with the first embodiment of the invention, a portable alarm comprises a housing having a configuration with a base and at least one wall extending from the base forming a closed configuration. A top encloses the at least one wall. Electronics are positioned in the housing. The electronics assist in communicating with sensors, as well as with a central monitoring station. A battery is positioned in the housing to power the electronics. A sensor is positioned on the housing to detect movement in the proximity of the housing. The sensor is coupled with the electronics. An alarm is coupled with the housing to provide an audible or visual signal in response to signals received from the electronics indicating a breach has occurred. The alarm is also coupled with the electronics. A device on the housing enables selective programming of the electronics. The device includes a readout to enable a user to visually interpret programming of the device. The device is electrically coupled with the electronics. The device includes a keyboard and a readout. A cover is coupled with the housing to cover the keyboard. The alarm may be a siren or a strobe light or both. Additional sensors are coupled with the electronics to monitor remote locations from the base unit. The housing includes an attachment mechanism to attach the housing to a bracket.

According to a second embodiment of the present invention, a portable alarm comprises a housing having a configuration with a base and at least one wall extending from the base forming a closed configuration. A top encloses the at least one wall. Electronics are positioned in the housing. The electronics assist in communicating with sensors, as well as with a central monitoring station. A battery is positioned in the housing to power the electronics. A sensor is positioned on the housing to detect movement in proximity of the housing. The sensor is coupled with the electronics. An alarm is coupled with the housing to provide an audible or visual signal in response to signals received from the electronics indicating that a breach has occurred. The alarm is coupled with the electronics. A device on the housing enables selective programming of the electronics. The device includes a readout to enable a user to visually interpret programming of the device. The device is electrically coupled with the electronics. The device includes a keyboard and an LCD readout. An attachment mechanism is on the housing. A bracket includes a mechanism to couple with the housing attachment mechanism to removably secure and lock the housing on the bracket. The attachment mechanism includes at least one blind hole to receive a L-shaped finger from the bracket to couple the two together. The bracket has an overall cross-shape with a vertical and horizontal arm. The horizontal arms are bent to surround the housing wall. One vertical arm is bent to surround the base and the other vertical arm includes the coupling mechanism. The bent vertical arm receives a locking mechanism to lock the base with the bracket.

According to a third embodiment of the present invention, a monitoring system comprises a housing having a desired configuration with a base and at least one wall extending from the base forming a closed configuration. A top encloses the at least one wall. Electronics are positioned in the housing. The electronics assist in communicating with sensors, as well as with a central monitoring station. A battery is positioned in the housing to power the electronics. A sensor is positioned on the housing to detect movement in proximity of the housing. The sensor is coupled with the electronics. An alarm is coupled with the housing to provide an audible or visual signal in response to signals received from the electronics which indicate that a breach has occurred. The alarm is coupled with the electronics. A device on the housing enables selective programming of the electronics. The device includes a readout to enable a user to visually interpret programming of the device. The device is electrically coupled with the electronics. The device includes a keyboard and a readout. A central monitoring station receives input from the alarm electronics. The central monitoring station notifies predetermined parties of the system breach. The monitoring system includes wireless contact sensors, motion sensors, and vibration sensors which may be coupled with the alarm electronics. The portable alarm may be positioned inside of a first structure and the wireless sensors may be in a second structure or in an ambient environment.

From the following detailed description, taken in conjunction with the accompanying drawings and claims, other objects and advantages of the present invention will become apparent to those skilled in the art.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
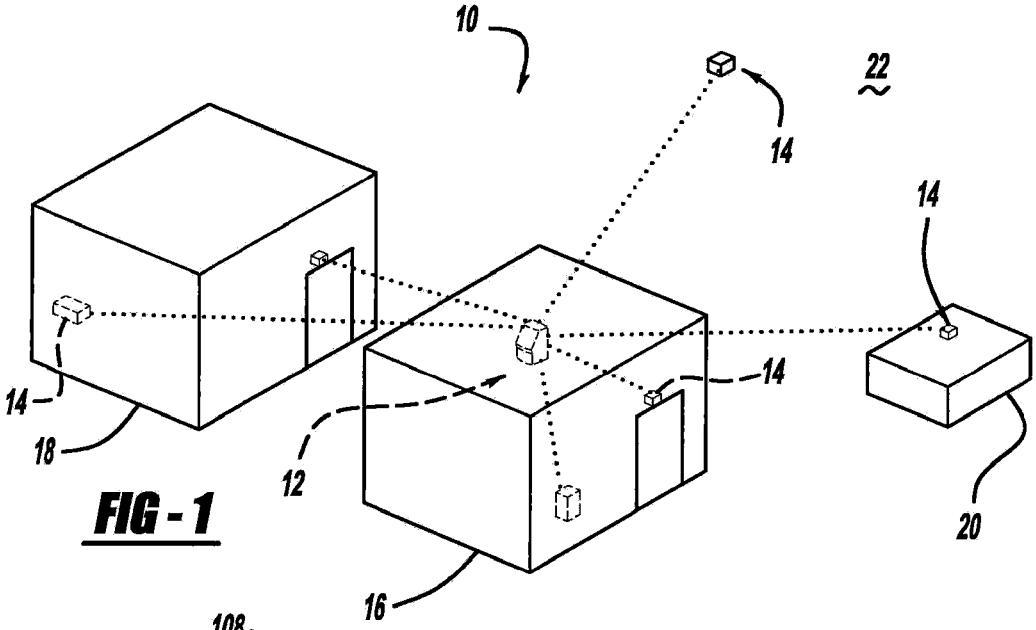
FIG. 1 is a schematic view of a monitoring system in accordance with the present invention.

Turning to the figures, a portable alarm system is illustrated and designated with the reference numeral 10. In FIG. 1, the alarm system 10 includes a base unit 12 and at least one sensor 14. The base unit 12 is ordinarily positioned within a structure 16 such as a building, dwelling or the like. The sensors 14 can be positioned within the building 16 with the base unit 12. Also, sensors 14 can be positioned within adjacent structures 18, containers, such as tool boxes 20, or in the ambient surrounding area 22. The sensors 14 are wireless sensors and can be of the motion detection type, vibration type, or contact type. Thus, the sensors 14 can be positioned at windows or doors as a contact type, within a tool box which is opened or closed, as a vibration type, or they can be positioned within the dwelling or in the surrounding area, as a motion sensing type. In the event that the sensors are positioned outside in the ambient environment, the sensors would be designed to withstand exposure to the environment.

Figure 2:
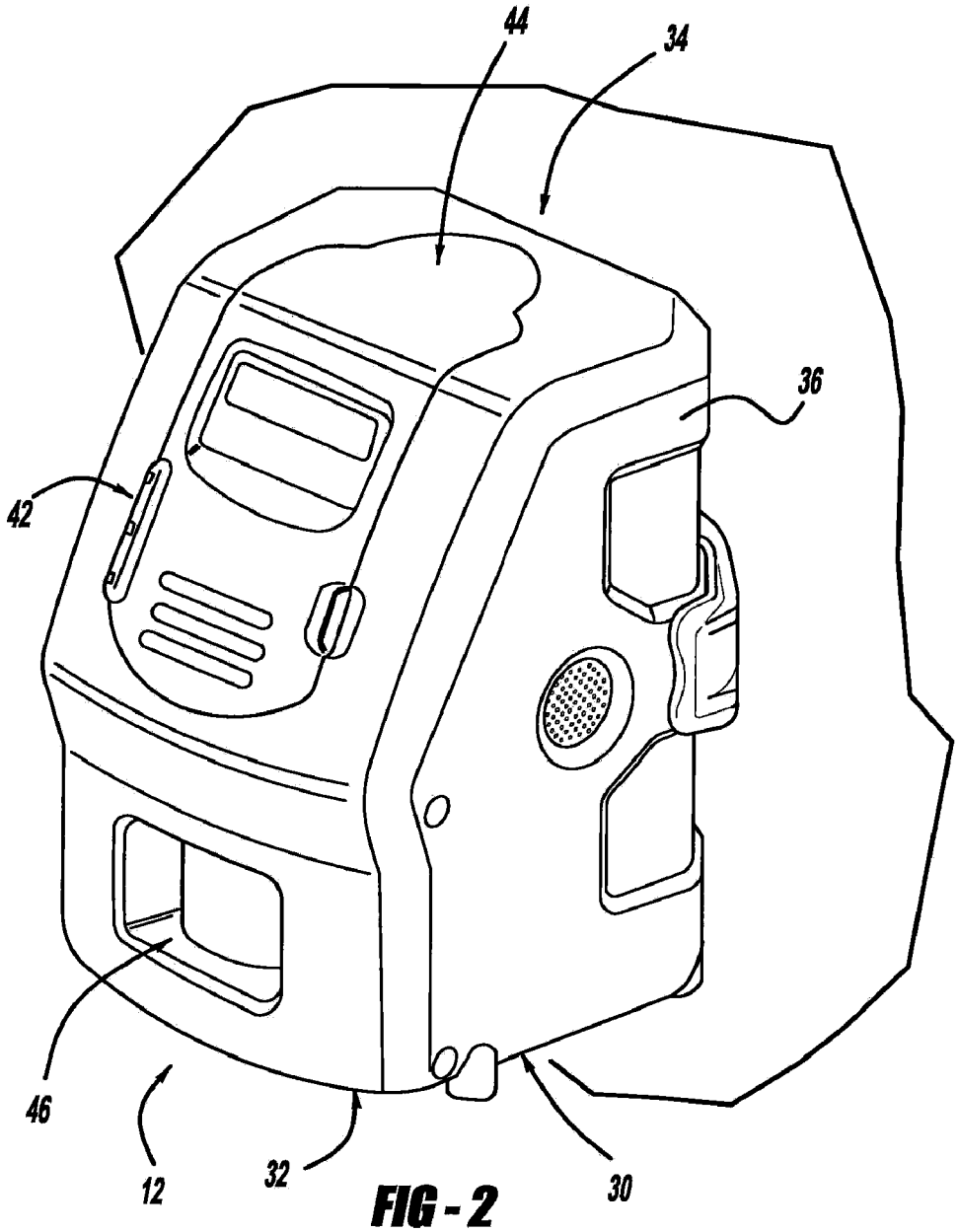
FIG. 2 is a perspective view of a base unit of the alarm system in accordance with the present invention.
Figure 3:
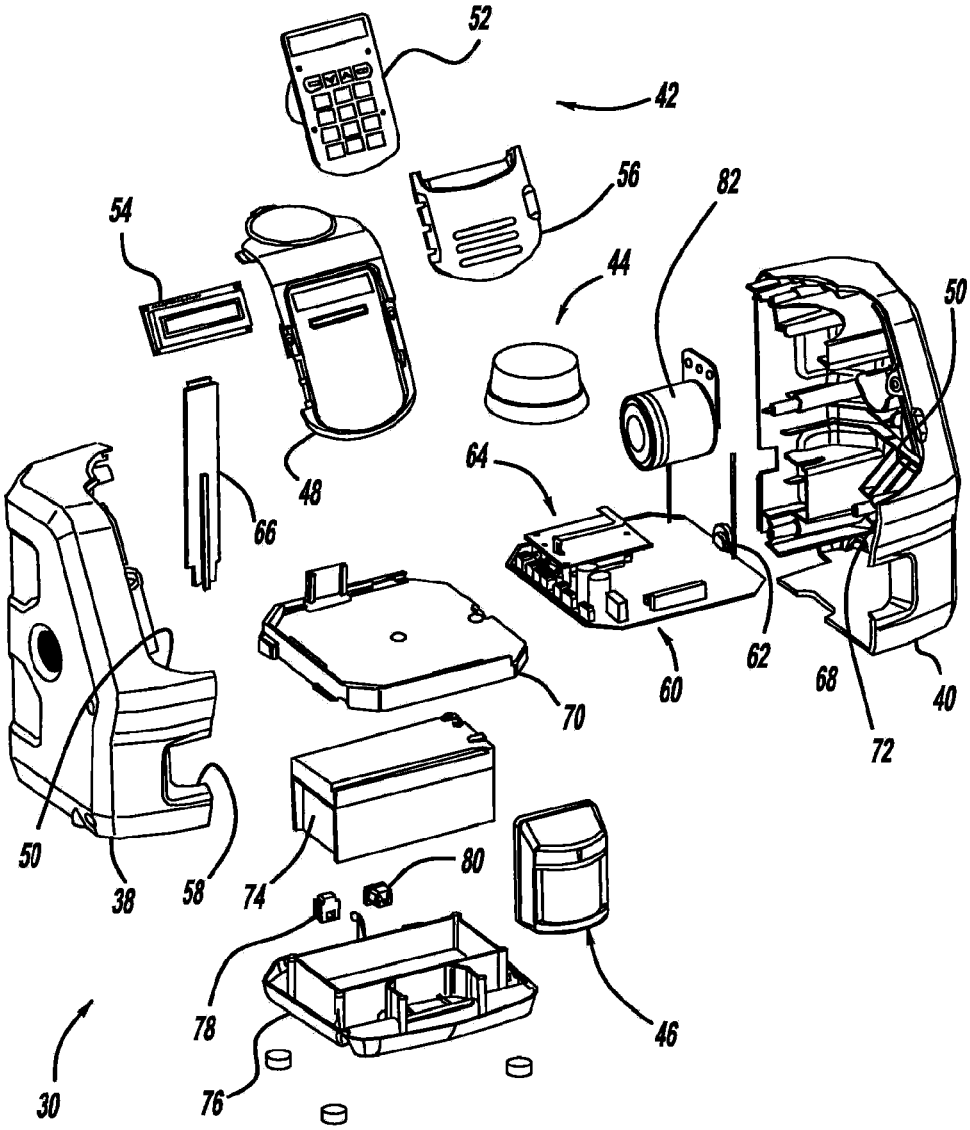
FIG. 3 is an exploded view of FIG. 2.

In turning to FIGS. 2 and 3, the base unit 12 is illustrated. The base unit 12 includes a housing 30 with a base 32, a top 34 and a wall 36. The housing has an overall box shape configuration. As shown, the housing 30 includes a pair of members 38 and 40 which are secured together to form the base unit housing 30. The base unit also includes a control panel 42, a strobe alarm 44 and a motion detector 46.

The control panel 42 includes a panel housing 48 which fits into an opening 50 in the housing 30. The control panel 42 includes a keypad 52 with a display 54. The display 54 is generally an LCD display. The keyboard 52 is like that commonly found on cellular telephones. The keyboard 52 has numbers, letters and function keys provided to access different steps of the programmable unit. A door 56 covers the keypad to prevent unwanted touching of the keypad during operation. The keypad 52 is electrically connected with the base unit electronics to enable programming of the unit.

The strobe 44 is coupled with the control panel housing 48 and provides a visual alarm. If a sensor is tripped or set off, the strobe light 44 would be activated to produce a visual alarm.

The motion sensor 46 is built into the housing 30. The housing includes an opening 58 to receive the motion sensor 46. Thus, the base unit includes a motion sensor to detect movement within the building where the portable base unit is mounted. Also, the motion sensor 46 is electrically coupled with the base unit electronics.

FIG. 3 illustrates an exploded view of the base unit 12. The base unit electronics 60 is illustrated. The base unit electronics 60 includes a PC board 62 with various conventional elements utilized to operate the alarm system. The PC board also includes a cellemetry modem 64 coupled with a cellemetry antenna 66. The antenna is utilized to transfer signals between a central monitoring station and the portable alarm base unit 12. A chime 68 is electrically coupled with the electronic 60. Accordingly, as different commands are programmed into the alarm, via the keyboard 52, the chime 68 will sound indicating that the programmed command has been entered/received.

The electronics 60 seat on a retention bracket 70. The retention bracket 70 has an overall rectangular configuration and seats within receiving members 72 within the housing halves 38 and 40. The retention bracket 70 separates the electronics 60 from a battery 74, which is electrically coupled with the electronic 60. The battery 74 sits within a support tray 76. The support tray 76 is positioned on top of the base 32 of the housing 30. The support tray maintains the battery 74 in position within the housing 30. Also, a telephone jack 78, as well as a power jack 80, are coupled with the electronic 60. The telephone jack 78 may be utilized in the event the portable alarm is hard wired to a conventional telephone outlet. However, the portable alarm cellemetry modem 64 enables the portable alarm to have a wireless connection so that it communicates like a cellular phone. The power jack 80 receives a power cord (now shown). The power cord would be connectable to a standard AC outlet. The AC outlet may be utilized to charge the battery 74 or to power the electronics 60 if conventional electrical hookup is present. The electronics 60 include a loop for recharging the battery 74, as well as directly powering the electronics from the power jack 80.

A siren 82 is positioned within the housing 30. The siren 82 provides an audible alarm if a breach occurs. The siren 82, as well as the chime 68 is positioned against an area of the respective housing half 38 and 40 which includes a plurality of holes to enable sound to escape from the siren 82 or chime 68.

The base unit electronics 60 are wirelessly associated with the sensors 14. The electronics 60 receive and transmit signals to the sensors 14 which monitor their various areas. Thus, the wireless signals are transmitted between the two in the event a breach occurs.

Figure 4:
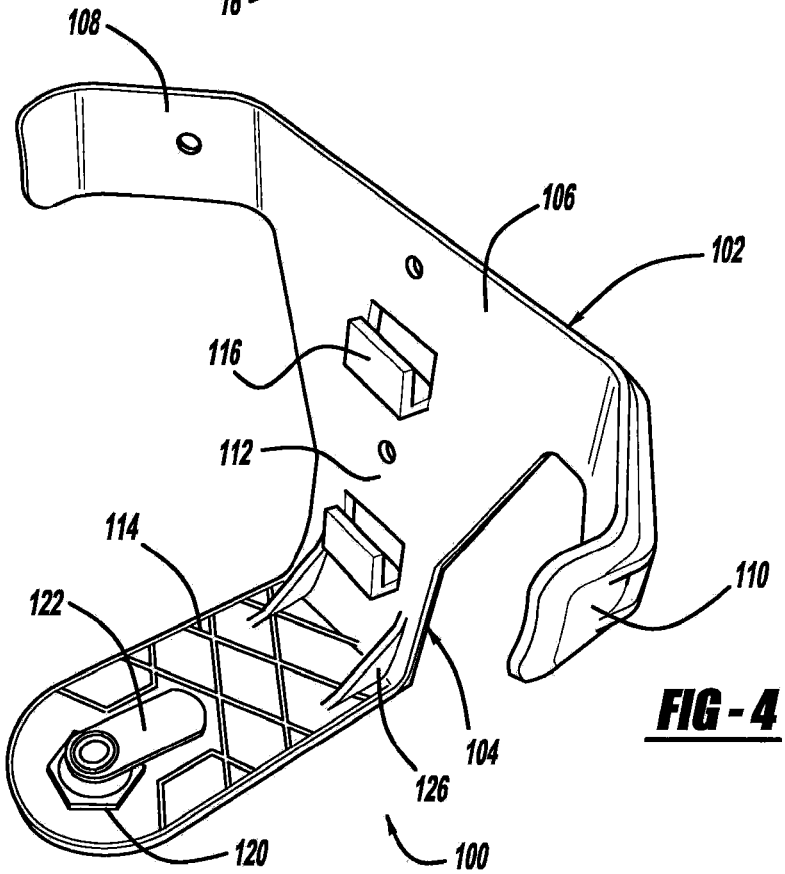
FIG. 4 is a perspective view of the alarm system bracket.
Figure 5:
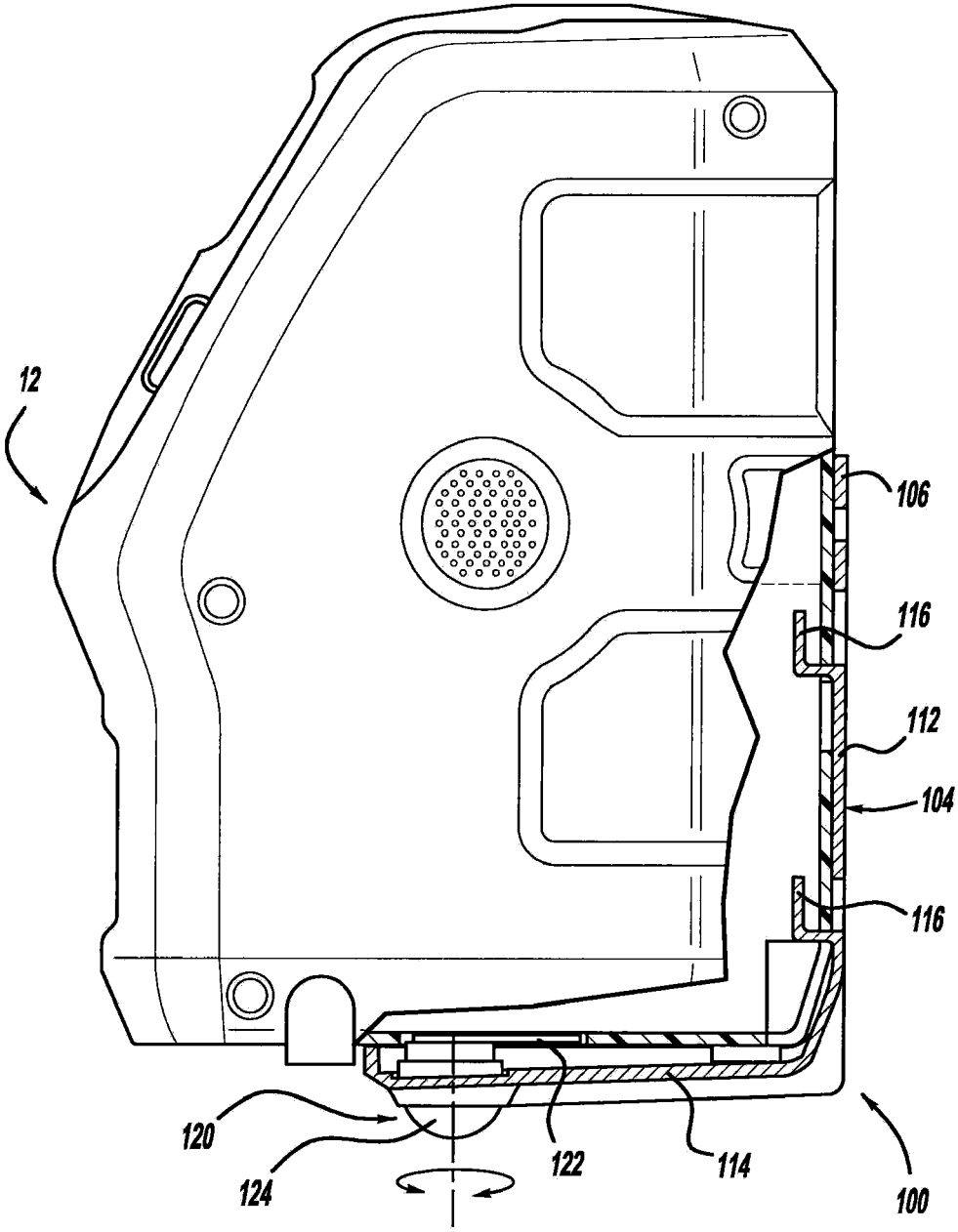
FIG. 5 is a cross-section view of the bracket with the alarm base secured in the bracket.

Turning to FIGS. 4 and 5, a bracket 100 is illustrated to mount the base unit 12 to a surface such as a wall or the like. The bracket 100 has an overall T-shape with a horizontal leg 102 and a vertical leg 104. The horizontal leg 102 includes a planar portion 106 with angled end portions 108 and 110. The planar body portion 106 and end portions 108 and 110 surround the wall of the housing 30 to enable the bracket to seat with the housing. The vertical leg 102 may include a plurality of apertures to enable fasteners to pass through the bracket to enable the bracket to be mounted to a surface.

The vertical leg 104 is unitary with the horizontal leg 102 and includes a first portion 112 and a bent second portion 114. The portion 114 is substantially perpendicular to the portion 112. The portion 112 is substantially planar with the body portion 106. The vertical portion 112 includes at least one, and preferably a plurality of L-shaped members 116. The L-shaped members 116 are received into apertures in the housing wall to retain the housing onto the bracket 100. The L-shaped members 116 are received in blind holes in the housing 30. Also, the bracket portion 112 seats with the wall of the housing 30.

The bent portion 114 seats with the base of the housing 30. The portion 114 includes a locking member 120 which secures within a blind hole in the base of the housing 30. The locking mechanism 120 includes a tongue 122 which moves in and out of the blind hole of the housing base. A key member 124 rotates the tongue from a locking to an unlocking position. Thus, the base unit 12 is positioned onto the L-shaped members 116 and locked in position by the locking mechanism 120. Also, reinforcement members 126 are present between the bent portion and vertical portion 112.

The alarm system 10 is programmable via the keypad and can be moved from place to place. The sensors 14 are wireless sensors and can be positioned within the building to monitor doors, windows, or the like. Also, the sensors 14 can be remote motion sensors which could be in an adjacent building or in an outside ambient area. Further, vibration sensors could be used in a container, such as a toolbox to monitor the opening/closing of the toolbox as well as its movement. Also, the motion sensor on the base itself acts as a conventional motion detector.

In the event that the alarm system is breached, a signal would be sent from the sensors 14 to the base unit 12. The base unit 12 would initiate a signal to the siren/strobe and via the electronics a signal would be transmitted to a central monitoring station. The central monitoring station would contact a designated person to indicate that the system has been breached. The strobe and siren would provide a visual and audible alarm to deter an unauthorized intruder. The monitoring station and/or the designated person would dispatch proper authorities to the site. Thus, the portable alarm system functions like a hard wired system without the need of the wires or the permanency of the system.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A portable alarm comprising:

a housing, said housing having a configuration with a base at least one wall extending from said base forming a closed configuration and a top enclosing said at least one wall;

electronics in said housing for providing monitoring;

said electronics transmitting signals to a central monitoring location;

a battery in said housing for powering said electronics;

a sensor on said housing, said sensor for detecting movement of objects in proximity of said housing, said sensor electrically coupled with said electronics;

an alarm coupled with said housing for providing an audible or visual signal in response to signals from said electronics, said alarm electronically coupled with said electronics;

a device on said housing for enabling selective programming of said electronics, said device including a read out for enabling a user to visually interpret the programming, said device electrically coupled with said electronics; and an attachment mechanism for attaching to a support, said attachment mechanism including at least one blind hole for receiving a L-shaped finger of a bracket coupling mechanism, and said attachment mechanism coupled with said housing.

2. The portable alarm according to claim 1, wherein said selective programming device including a keyboard and an LCD readout.

3. The portable alarm according to claim 2, wherein a cover coupled with said housing for covering said keyboard.

4. The portable alarm according to claim 1, wherein said alarm including a siren.

5. The portable alarm according to claim 1, wherein said alarm including a strobe light.

6. The portable alarm according to claim 1, wherein said alarm including a strobe light and a siren.

7. The portable alarm according to claim 1, wherein wireless sensors may be coupled with said electronics for monitoring remote locations.

8. A portable alarm comprising:

a housing, said housing having a configuration with a base at least one wall extending from said base forming a closed configuration and a top enclosing said at least one wall;

electronics in said housing for providing monitoring;

said electronics transmitting a signal to a central monitoring location;

a battery in said housing for powering said electronics;

a sensor on said housing, said sensor for detecting movement of objects in proximity of said housing, said sensor electrically coupled with said electronics;

an alarm coupled with said housing for providing an audible or visual signal in response to signals from said electronics, said alarm electronically coupled with said electronics;

an attachment mechanism on said housing, said housing attachment mechanism including at least one blind hole; and a bracket, said bracket including a mechanism for coupling with said housing attachment mechanism for removably securing said housing on said bracket, said bracket coupling mechanism including a L-shaped finger being received in said at least one blind hole; and a locking mechanism on said bracket, said locking mechanism coupling with said housing receiving mechanism for actively moving between a locked position and an unlocked position for locking said housing on said bracket in said locked position such that said housing is non-removably coupled with said locking mechanism until said locking mechanism is deactivated into said unlocked position to enable removal of said housing from said locking mechanism.

9. The portable alarm according to claim 8, wherein said housing including a receiving mechanism.

10. The portable alarm according to claim 8, wherein said bracket has an overall cross-shape with a vertical and horizontal arm, said horizontal arms being bent at its ends to surround said housing wall, said vertical arm being bent to surround said base and the non-bent portion of said vertical arm including said coupling mechanism.

11. The portable arm according to claim 10, wherein said bent vertical arm portion including a locking mechanism.

12. The portable arm according to claim 8, wherein said receiving mechanism being on said base and said locking mechanism including a key mechanism.

13. The portable arm according to claim 11, wherein said non-bent vertical arm portion including a device for retaining said bracket on a mounting surface.

* * * * *